United States Patent [19]

Fanson et al.

[11] Patent Number: 4,888,965

[45] Date of Patent: Dec. 26, 1989

[54] WATER DIVERTER FOR SPINNING BASKET OF AUTOMATIC WASHER

[75] Inventors: Richard L. Fanson; Ralph E. Denny, both of St. Joseph Township Berrien County, Mich.

[73] Assignee: Whirlpool Corporation, Benton Harbor, Mich.

[21] Appl. No.: 254,308

[22] Filed: Oct. 5, 1988

[51] Int. Cl.[4] ..... D06F 17/06; D06F 39/08

[52] U.S. Cl. ..... 68/23.4; 68/148; 68/171; 210/380.2; 210/382

[58] Field of Search ..... 68/23 R, 23.3, 23.4, 68/23.7, 53, 148, 152, 154, 171, 174; 210/247, 379, 380.1, 380.2, 382; 34/58

[56] References Cited

U.S. PATENT DOCUMENTS

| | | | |
|---|---|---|---|
| 1,604,748 | 10/1926 | Grauer | 68/23 R X |
| 1,700,749 | 2/1929 | Sinclair | 210/382 X |
| 2,201,685 | 5/1940 | Lorenzen | 68/148 |
| 2,264,202 | 11/1941 | Forney | 68/23 |
| 2,526,344 | 10/1950 | Geldhof et al. | 68/148 |
| 2,683,535 | 7/1954 | Smith | 210/382 |
| 2,711,827 | 6/1955 | Smith | 68/23.4 X |
| 2,718,772 | 9/1955 | Sharp et al. | 68/23.4 |
| 2,816,429 | 12/1957 | Kurlancheek | 68/19 |
| 2,935,168 | 5/1960 | DeRemer | 68/23 R X |
| 3,216,224 | 11/1965 | Poole | 68/23.4 |
| 3,324,688 | 6/1967 | Hubbard | 68/4 |
| 3,722,234 | 3/1973 | Douglas | 68/23.5 |

FOREIGN PATENT DOCUMENTS

| | | | |
|---|---|---|---|
| 147499 | 7/1952 | Australia | 68/23 R |

*Primary Examiner*—Philip R. Coe

*Attorney, Agent, or Firm*—Hill, Van Dante, Steadman & Simpson

[57] ABSTRACT

A liquid diverter is provided in an automatic washer to cause a spray of liquid to impact on the side wall of the tub above a top level of perforations of the basket to assure that any suds or other extraneous matter is rinsed from the tub wall at such an elevation and is not allowed to remain there after a given wash cycle. The diverter is in the form of a ring which is carried on and rotates with the wash basket and includes a plurality of downwardly depending rib pairs which support therebetween a liquid intercepting wall and an inclined channel. The inclined channel directs the liquid upwardly when the basket is spinning so that the diverted liquid will impact against a higher elevation of the tub wall.

14 Claims, 2 Drawing Sheets

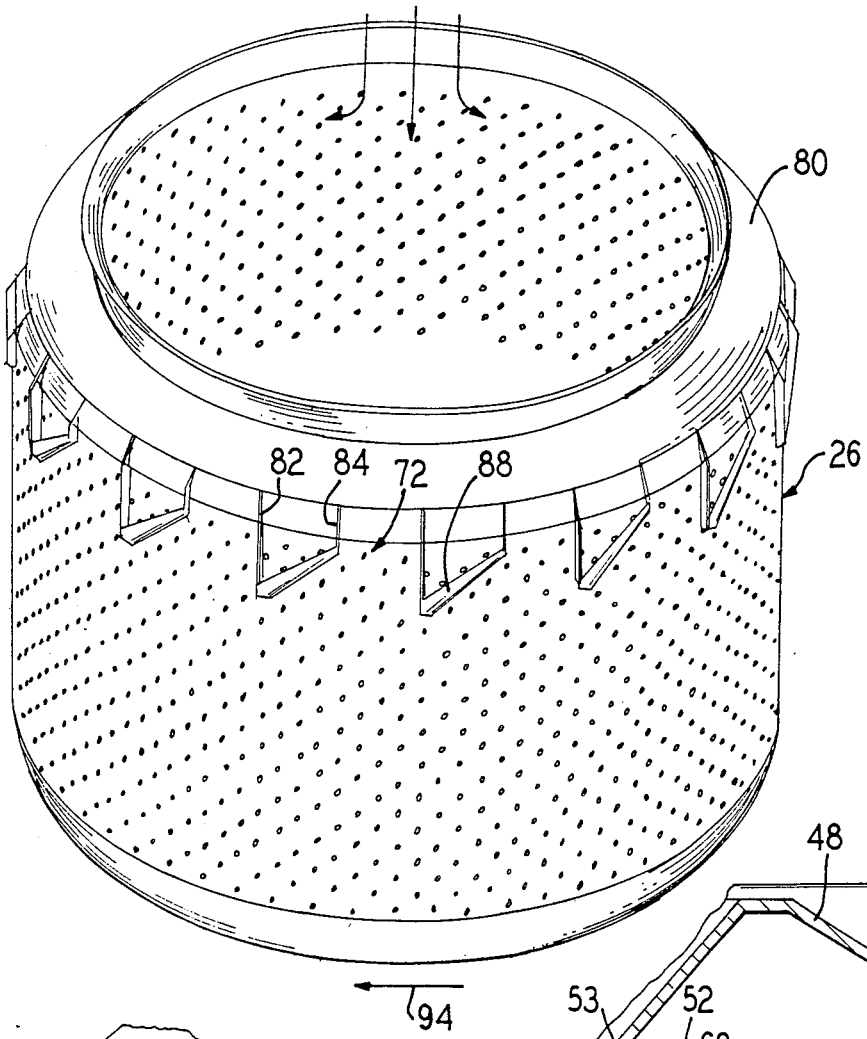
FIG. 3
FIG. 4
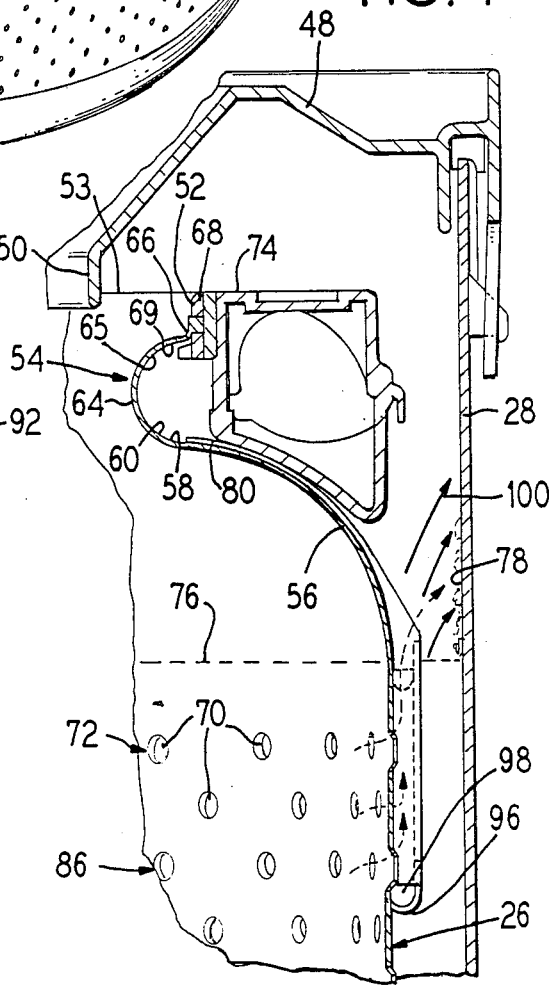
FIG. 5
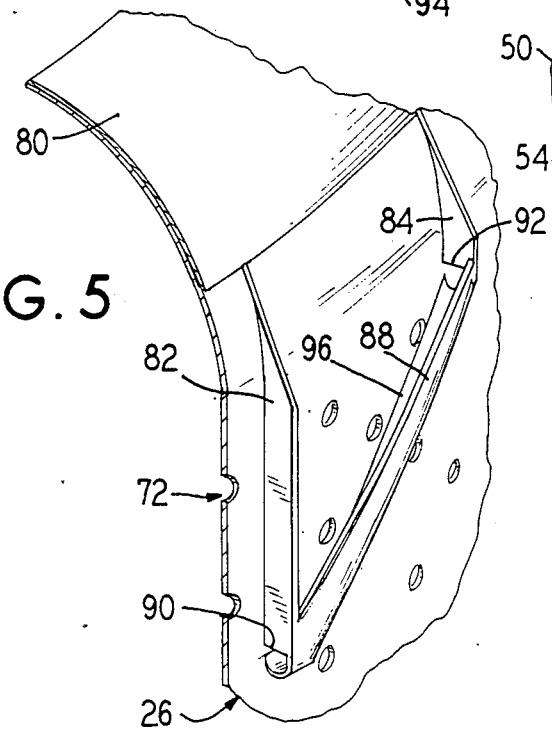

WATER DIVERTER FOR SPINNING BASKET OF AUTOMATIC WASHER

BACKGROUND OF THE INVENTION

The present invention relates to automatic washers and more particularly to vertical axis automatic washers having a perforate wash basket carried within an imperforate wash tub.

Wash baskets for vertical axis agitator washers oftentimes have a perforate wash basket which carries a load of fabrics to be treated in the washing liquor, through a series of agitation, spinning and rinsing steps. Generally the basket has a configuration which, although substantially cylindrical, is deformed somewhat near the top open end in order to carry thereon a balancing ring or other such structure in order to ensure the stability of the wash basket during periods of high spin in the wash cycle. Therefore, the perforated region generally extends only below this upper inwardly deformed portion of the wash basket.

During certain periods of the wash cycle, particularly during the agitate portion of the cycle, there is a creation of suds due to mechanical agitation of the fabric load and wash liquor, which suds generally are carried on the top surface of the wash liquor. Other matter such as dislodged dirt, lint and oils, all of which may have a density less than that of the wash liquor may also be carried at or close to the surface of the wash liquor. In the instances where there is a relatively full load of fabric being washed, the top surface of the wash liquor may be above the top row of perforations in the wash basket and therefore the suds and other materials would engage the sidewall of the tub and outer basket at such an elevation. During the draining portion of the cycle some of the suds and other materials adhere to the sidewall of the tub and outer basket at such elevation. During subsequent rinsing cycles the rinse liquid level may not achieve the same elevation, particularly if a lesser degree of agitation is involved in the rinse cycle and therefore a build up of the detergent and other materials, sometimes referred to as scrud, would occur on the tub wall and outer basket in this relatively inaccessible location.

Such a scrud buildup may affect the performance level of the washer in subsequent wash cycles due to redeposition of the scrud onto the fabric load being treated in a later operation. Also, the scrud buildup may become a source of undesireable odors. Because of the relatively inaccessible location of the tub elevation subject to the scrud build up, manual cleaning of the area is not readily possible.

Therefore, it would be an improvement in the art if a means were provided to ensure that any materials deposited on the interior of the tub wall were completely removed during each wash cycle.

SUMMARY OF THE INVENTION

It is an object of the present invention to provide a liquid diverter means for use in combination with a rotating cylindrical vessel wherein the vessel has a perforated wall to permit liquid to flow out through the perforations, the diverter comprising a rib member engageable with an exterior of the vessel having wall means oriented to intercept and redirect the liquid flowing out of the perforations.

It is a further object of the invention to provide a means for directing a rinse liquid to an area of the inner tub wall in a vertical axis automatic washer which is above the level of perforations of the rotatable wash basket.

It is a still further object of the invention to provide a water diverting means for directing some of the water exiting through the perforations of the wash basket upwardly and outwardly toward an upper area of the wash tub.

In order to achieve these objects, the present invention provides a diverter ring which is carried on the outside of the basket at the top inwardly deformed portion between the basket and the balancing ring. The diverter ring has a plurality of spaced channels which depend from the ring on support ribs and which overlie some of the perforations in the wash basket. The channels are constructed so as to divert water flowing out of the perforations from a radially outward direction to a vertically upward and outward direction so that the water will impact the interior of the wash tub at an elevation higher than the top row of perforations of the wash basket. The design of the channels uses the centrifugal force created by the spinning basket to direct the spray water upwardly on the upper part of the basket. The centrifugal force will then move the spray water to the inner tub surface.

Thus, a forceful spray of rinse liquid will be directed against the inner tub wall at an elevation above the highest perforations in the wash basket to assure that the tub wall will be rinsed clean during each wash cycle.

BRIEF DESCRIPTION OF THE DRAWINGS

FIG. 3 is a perspective view of the wash basket and water diverter ring separated from the remainder of the washer for clarity.

FIG. 4 is a sectional view through a top portion of the wash basket and tub.

FIG. 5 is a perspective sectional view of the top of the basket of FIG. 3.

DESCRIPTION OF THE PREFERRED EMBODIMENTS

Although the present invention is useful in many environments, particularly where a cylindrical vessel is rotatable and has a perforated wall to permit liquid to flow through the wall, the invention finds particular utility in the environment of an automatic washer wherein a perforate wash basket is rotatable within a wash tub. Therefore, the invention will be described with respect to such an environment although the invention should not be construed as being limited to such an environment.

Figure 1:
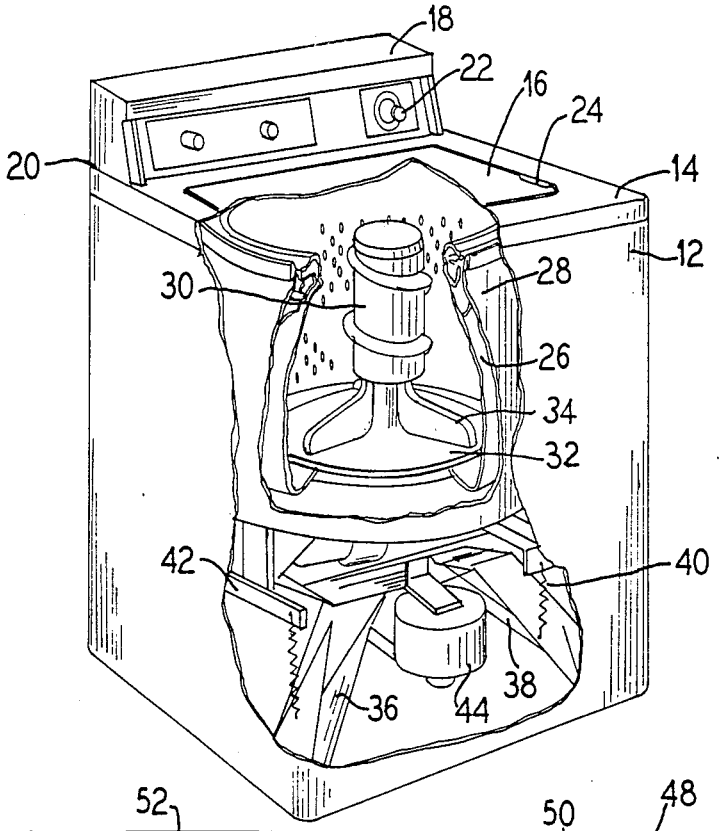
FIG. 1 is a perspective view of an automatic washer embodying the principles of the present invention.

In FIG. 1, there is illustrated an automatic washing machine generally at 10 having an exterior cabinet 12 with a top surface 14 and an openable lid 16 forming a portion of the top surface. A control console 18 is positioned at a rear edge 20 of the panel 14 and has on it a plurality of controls 22 for presetting the operation of the washer to operate through a series of washing, rinsing and drying steps.

Accessible through an opening 24 covered by the lid 16 is a perforate wash basket 26 concentrically mounted within an imperforate wash tub 28. Mounted centrally within the wash basket is a vertical axis agitator 30 having a lower skirt portion 32 and a plurality of radially outwardly extending vanes 34.

The wash tub assembly is carried on supporting legs 36 which are connected to a washer frame 38 interior of the cabinet 12. Shock and vibration absorbing means 40 generally comprising springs are attached between the legs 36 and a plurality of brackets 42 secured to the tub assembly. The agitator 30 and wash basket 26 are selectively oscillated and rotated by means of an electric motor 44 through an appropriate transmission 46.

Figure 2:
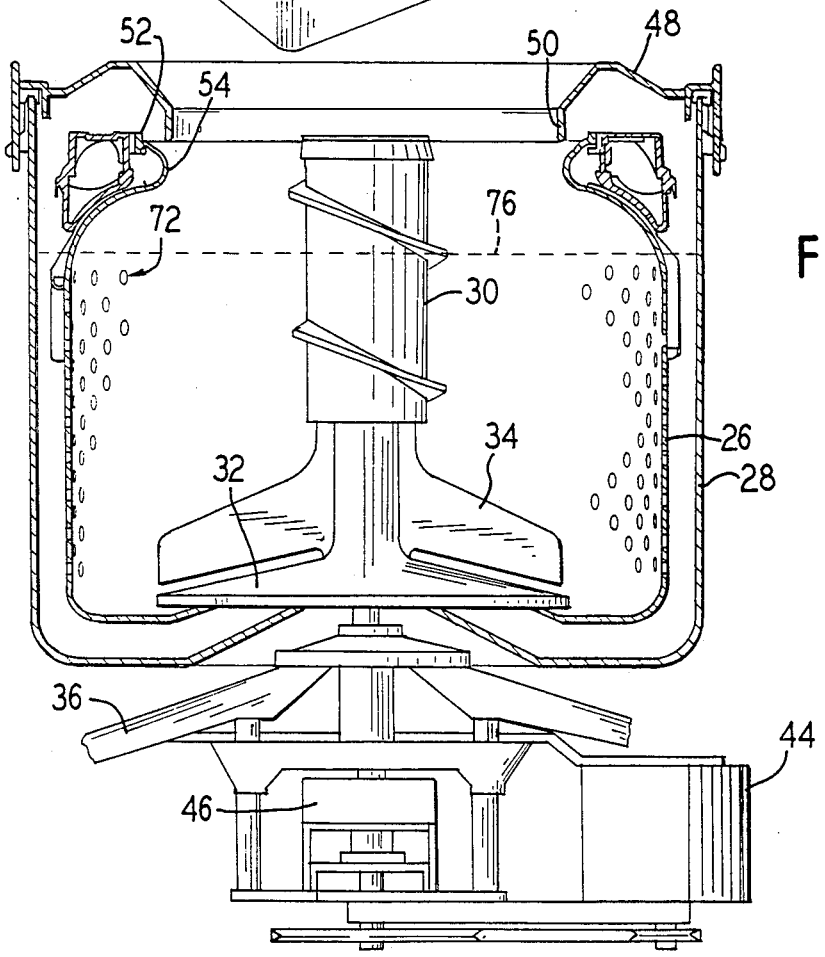
FIG. 2 is a side sectional view through the interior of the washer of FIG. 1.

The interior of the wash basket 26 is shown in greater detail in FIG. 2 which is a cross-sectional view of the wash basket and lower portion of the washer interior of the cabinet. It is clearly seen that the wash basket 26 is mounted concentrically within the wash tub 28 and that the agitator 30 is centrally located. The wash tub 28 has an attached top ring 48 with an opening 50 therein providing access to the interior of the wash basket. The wash basket 26 has a substantially circular opening 52 at a top edge 53 thereof which is smaller in diameter than the internal diameter of the wash basket 26 itself in that a curled upper lip 54 is formed at the top end of the basket 26 to form the opening 52.

The curled lip portion 54 is shown in greater detail in FIG. 4 where it is seen that there is a first inwardly curved portion 56 which extends inwardly from the diameter of the wash basket 26 thereby forming an exterior shoulder 58 near a top portion of the wash basket. The slope of the curved portion 56 decreases in a direction toward the top edge 53 of the basket 26 to a transition point 60 from which point the scope increases along a portion 62 through a vertical slope at a neck portion 64, continuing to curve an outwardly along a downwardly facing portion 65 at a substantially equal radius is the portion 62 to a point 66 from once the basket wall continues vertically upwardly in a portion 68 forming the opening 52. The portion 65 between the narrow neck portion 64 and a transition point 66 to the vertical portion 68 forms a lip 69.

The basket 26 has a plurality of rows of perforations 70 extending through the vertical sidewalls thereof which extend up to a top row 72 of perforations which is spaced somewhat below the top edge 53 of the basket for various reasons. First, seated on the curved portion 56 of the basket is a balancing ring 74, such as that disclosed in U.S. Pat. No. 4,646,545 assigned to the assignee of the present invention. The balancing ring is used to assure that the basket will remain stable during high speed spinning. Since the balancing ring 74 is an annular structure, perforations cannot extend up to the area which the balancing ring overlays. Further, the manufacturing process which forms the perforation and the basket wall requires that the perforations be formed in the flat cylindrical portion of the wall and not in the curved portion 56.

During a large load condition, wherein a full load of fabrics are treated within the washer, a maximum level 76 of wash liquor within the basket and tub may be at an elevation higher than the top row 72 of perforations. Soap suds, lint, oil films and other matter, sometimes referred to as scrud, which is less dense than the water liquor, tends to float to the surface of the wash liquor. During the agitation portion of the wash cycle, the level of wash liquor within the wash basket and tub fluctuates due to the turbulence in the wash liquor and as the surface level rises and falls within the tub 28, this scrud is deposited on the interior surface of the tub 28 at an elevation 78 which is higher than the top row 72 of the perforations.

In order to assure that the scrud deposited on the tub wall is completely rinsed off and carried away during the wash cycle, so that it will not remain on the tub wall to be redeposited upon a later wash load or build up further on the tub wall, a liquid diverter 79 is provided to cause a spray of liquid to impact against the tub wall at the elevation 78 above the top row 72 of perforations.

This liquid diverter 79 preferably is in the form of a ring 80 which lies on top of the exterior shoulder 58 of the curved portion 56 at the top of the basket and completely encircles the top portion of the basket. The balancing ring 74 then rests on top of the ring 80 which assists in holding the ring 80 firmly in place.

The ring 80 includes a plurality of downwardly depending pairs of support ribs 82, 84 which overlie a portion of the exterior surface of the basket 26. One support rib 82 of each pair extends downwardly beyond the top row 72 of perforations, and preferably to at least a third row 86. The second rib 84 of the pair is substantially shorter and may terminate above the top row 72 of perforations.

Extending between each pair of ribs 82, 84 is a vertical wall 88 which connects a bottom edge 90, 92 respectively of each of the two ribs 82, 84 and which extends vertically slightly above and slightly below the bottom edges 90, 92 of the ribs. Because of the difference in height of the two ribs, the wall 88 is angled from a horizontal orientation. The wash basket, during a spin mode, generally rotates in one given direction, shown in FIG. 3 as being a clockwise direction by arrow 94. The rib pairs 82, 84 are arranged such that the connecting wall 88 is lowest at the counterclockwise of the two ribs so that as the basket rotates, a leading edge **88*a* of the wall 88 will be at the lowest elevation and a trailing edge 88*b* will be at the highest elevation at rib 84**.

At a bottom edge **88*c* of the wall 88 is formed a channel 96 which has a U-shape in cross section. An interior 98 of the channel 96 is exposed at each end of the wall 88 below the bottom edges 90, 92 of the ribs 82, 84 such that liquid is free to flow from the channel 96 below the support ribs 82, 84**.

During the agitate portion of the wash cycle, the diverter ring with the depending ribs and channels does not have any significant effect on the washing operation or on the wash liquor which is flowing through the wash basket and within the space between the wash basket and tub. The retaining ring is held against rotation relative to the wash basket, both by the force of the balancing ring 74 lying on top of the ring 80 as well as by the fact that the perforations 70 extend slightly outwardly (FIG. 4) of the exterior surface of the wash basket as a natural consequence of the manufacturing process, and this slight outward projection causes the ribs of the diverting ring to engage the projections and therefore be prevented from rotating relative to the wash basket.

During the spin portion of the wash cycle, while the basket is rotated at a high rate of speed, the fabrics within the wash basket are pressed against the interior surface of the basket by centrifugal force and the centrifugal force causes the liquid within the basket, either the wash liquor or the rinse liquid to be flung from the basket through the perforations and against the wall of the tub 28. The wall 88 extending between the two ribs 82, 84 overlies some of the perforations near the top row 72 and diverts some of this fluid into the channel 98.

Due to the angled orientation of the channel, wherein the low end of the channel is at the leading edge of rotation, the liquid carried within the channel is forced upwardly by the rotation of the basket and is caused to move up along the outside wall of the basket from where centrifugal force causes the liquid to move outwardly and thus to be directed at the basket wall 28 at an elevation well above the top row 72 of perforations. As indicated by arrows 100 in FIG. 4, this diverted liquid is directed at the tub wall at an elevation equal to and above the maximum elevation 78 where the scrud is deposited. In this manner, rinse liquid is forcefully directed against the tub wall to rinse away an materials collected or deposited on the tub wall above the elevation of the top row 72 of the perforations.

At the end of the spin cycle, any liquid remaining in the channels 98 will quickly drain away because of the angled orientation of the channel and the open end below the edge 90 of the rib 82. Thus the liquid diverter is self draining and will not retain any liquid at the end of the wash cycle.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention is which an exclusive property or privilege is claimed are defined as follows:

1. An automatic washer comprising:

a wash tub with an open top;

a wash basket rotatably carried within said wash tub for receiving a fabric load and a liquid to wet said fabric load;

said wash basket having a perforated wall for providing liquid communication between said basket and tub, with a top row of perforations spaced below said top of said tub;

means for spinning said wash basket within said wash tub; and liquid diverter means comprising vertical rib means carried on an exterior of said wash basket having a substantially vertical liquid intercept wall means and a liquid carrying channel formed at an acute angle from horizontal to divert at least some liquid passing through said perforations during said spinning of said wash basket so said liquid will impact against said wash tub above said top row of basket perforations.

2. An automatic washer comprising:

a wash tub with an open top;

a wash basket rotatably carried within said wash tub for receiving a fabric load and a liquid to wet said fabric load;

said wash basket having a perforated wall for providing liquid communication between said basket and tub, with a top row of perforations spaced below said top of said tub;

means for spinning said wash basket within said wash tub; and liquid diverter means mounted adjacent to said perforations to divert at least some liquid passing through said perforations during said spinning of said wash basket so said liquid will impact against said wash tub above said top row of basket perforations;

said wash basket having an inwardly curved upper portion forming an exterior shoulder and said liquid diverter means comprising a ring seated on said shoulder.

3. An automatic washer according to claim 2, wherein said ring further comprises a plurality of downwardly depending ribs which support wall means positioned relative to said perforations so as to intercept and redirect said liquid.

4. An automatic washer according to claim 3, wherein said wall means comprises a liquid intercepting wall and a liquid carrying channel extending between a pair of said ribs.

5. An automatic washer according to claim 4, wherein said channel is disposed at an angle relative to horizontal so that said liquid is diverted vertically.

6. An automatic washer according to claim 4, wherein one of said ribs of said pair is shorter than the other and said wall means interconnects a bottom edge of each of said ribs, thus being disposed at an angle relative to horizontal.

7. An automatic washer according to claim 6, wherein said channel extends slightly below said bottom edge of each of said ribs such that liquid is free to flow out of said channel below said ribs.

8. A liquid diverter means for use in combination with a rotating cylindrical vessel wherein said vessel has a perforated wall to permit liquid to flow out through said perforations, comprising:

a rib member carried on an exterior of said vessel having a substantially vertical liquid intercept wall means and a liquid carrying channel formed at an acute angle from horizontal to intercept and redirect said liquid flowing out of said perforations.

9. A liquid diverter means for use in combination with a rotating cylindrical vessel wherein said vessel has a perforated wall to permit liquid to flow out through said perforations, comprising:

a rib member engagable with an exterior of said vessel having wall means oriented to intercept and redirect said liquid flowing out of said perforations;

said wall means comprises a liquid intercepting wall and a liquid carrying channel;

said wall means being supported by a pair of ribs;

said channel being disposed at an angle relative to horizontal so that said liquid is diverted vertically;

one of said ribs of said pair being shorter than the other and said wall means interconnecting a bottom edge of each of said ribs, thus being disposed at an angle relative to horizontal.

10. A liquid diverter means according to claim 9, wherein said channel extends slightly below said bottom edge of each of said ribs such that liquid is free to flow out of said channel below said ribs.

11. An automatic washer comprising:

a vertical axis wash tub with an imperforate side wall and an open top;

a wash basket rotatably carried within said wash tub for receiving a fabric load and a liquid to wet said fabric load;

said wash basket having a perforated wall for providing liquid communication between said basket and tub, with a top row of perforations spaced below said top of said tub, said wash basket wall having an external shoulder above said top row of perforations;

means for spinning said wash basket within said wash tub; and liquid diverter means comprising a ring seated on said shoulder, a plurality of pairs of ribs depending from said ring and wall means supported by said rib pairs, said wall means being positioned to intercept and redirect at least some liquid passing through said perforations during said spinning, said wall means comprising a liquid intercepting wall and a liquid carrying channel extending between each of said pairs of said ribs such that some liquid will be diverted after it has passed through said basket wall and will be redirected to impact against said tub wall above said top row of basket perforations.

12. An automatic washer according to claim 11, wherein said channel is disposed at an angle relative to horizontal so that said liquid is diverted vertically.

13. An automatic washer according to claim 11, wherein one of said ribs of said pair is shorter than the other and said wall means interconnects a bottom edge of each of said ribs, thus being disposed at an angle relative to horizontal.

14. An automatic washer according to claim 11, wherein said channel extends slightly below said bottom edge of each of said ribs such that liquid is free to flow out of said channel below said ribs.

* * * * *